United States Patent [19]

Watanabe et al.

[11] Patent Number: 4,684,351

[45] Date of Patent: Aug. 4, 1987

[54] OUTBOARD ENGINE STRUCTURE

[75] Inventors: Yoshimi Watanabe, Asaka; Kazuya Yamashita, Tokyo, both of Japan

[73] Assignee: Honda Giken Kogyo Kabushiki Kaisha, Shibuya, Japan

[21] Appl. No.: 758,050

[22] Filed: Jul. 23, 1985

[30] Foreign Application Priority Data

Jul. 26, 1984 [JP] Japan ..... 59-114157[U]
Jul. 30, 1984 [JP] Japan ..... 59-159786
Jul. 30, 1984 [JP] Japan ..... 59-159787

[51] Int. Cl.[4] ..... B63H 21/32
[52] U.S. Cl. ..... 440/89; 123/41.82 R
[58] Field of Search ..... 440/88, 89, 76, 77, 440/900; 123/193 H, 193 C, 193 CH, 41.82 R, 41.82 A, 196 R, 196 CP, 195 P

[56] References Cited

U.S. PATENT DOCUMENTS 2,507,034 5/1950 Martin ..... 440/88
4,554,892 11/1985 Amemori et al. ..... 440/89

*Primary Examiner*—Joseph F. Peters, Jr.
*Assistant Examiner*—Jesûs D. Sotelo
*Attorney, Agent, or Firm*—Roberts, Spiecens & Cohen

[57] ABSTRACT

An outboard engine structure including an extension case having a hollow portion formed therein and extending downwardly, the extension case being coupled with the lower surface of a crankcase of a vertical type engine, and including a driving shaft contained in the hollow portion of the extension case for transmitting power from the crankshaft of the engine to a propeller shaft. A cylinder block is connected at the rear of the engine with a cylinder head and slidably receives a piston on its cylinder bore, an exhaust passage block is interposed between the cylinder head and an extension section projecting rearwardly at the top of the extension case, and an exhaust port in the cylinder head communicates through an exhaust passage formed in the block with the hollow portion of the extension case. A water jacket is provided to surrounds the combustion chamber in the cylinder head and extends axially of the cylinder bore to an intermediate portion thereof, and the inlet and outlet passages for the water jacket are formed in the cylinder head.

12 Claims, 9 Drawing Figures

OUTBOARD ENGINE STRUCTURE

BACKGROUND OF THE INVENTION

1. FIELD OF THE INVENTION

The present invention relates to an outboard engine structure and, more particularly, to an outboard engine structure in which a crankcase of a vertical engine is connected to the upper surface of an extension case of which a hollow portion leads to an exhaust port located below a draft line and a crankshaft of the engine is coupled with a driving shaft for driving a propeller shaft arranged in the hollow portion and an exhaust system of the engine opens into the hollow portion.

2. DESCRIPTION OF THE PRIOR ART

In a conventional outboard engine structure of this type, as disclosed, for example, in Japanese Patent Laid-open No. 43895/1983 official gazette, the position of a cylinder head of the engine is substantially displaced from the center line of a hollow portion of an extension case. Thus, in order to lower the temperature of the exhaust gas of the engine and guide the gas to the hollow portion, an exhaust port is extended to the lower surface of the crankcase coupled to the upper surface of the extension case, an exhaust manifold leading to the exhaust port is suspended in the hollow portion, and both ends of the manifold are coupled to the crankcase and the extension case.

When an exhaust system of such conventional outboard engine structure is subjected to maintenance and inspections, such drawbacks and disadvantages arise that the entire engine must be removed from the extension case, resulting in lowering of the maintainability of the engine, and that the exhaust system has a complicated structure and requires a high manufacturing cost.

In the conventional engine of this type, a water jacket is formed to cover a wide range over a combustion chamber formed in the cylinder head as well as a lower portion of a cylinder bore formed in the cylinder block and having a piston slidably fitted therein and an inlet passage of the water jacket is formed in the crankcase connected with one side of the cylinder block.

However, in the engine of this type, cold water such as sea water is always supplied as coolant to the water jacket. Thus, when the engine employs the conventional water jacket and the inlet passage, cold water first flows into the inlet passage to cool the crankcase which is relatively unheated. Accordingly, the crankcase is overcooled to delay the temperature rise of lubricating oil in the crankcase, thereby extending a warming up operation of the engine.

SUMMARY OF THE INVENTION

It is, therefore, an object of the present invention to provide a simply constructed outboard engine structure of the abovementioned type which eliminates the aforementioned drawbacks and disadvantages and whose exhaust system has a high maintainability and can be readily disassembled into parts, and wherein the crankcase is kept from overcooling, the warming up operation of the engine is accelerated and the combustion chamber and the exhaust system are effectively cooled.

In order to achieve the above object, according to one aspect of the present invention, there is provided an outboard engine structure which comprises an exhaust passage block interposed and coupled between the lower surface of a cylinder head of the engine disposed at the rear of the engine and the upper surface of an extension section projecting rearwardly at the top of an extension case, whereby the exhaust system is constituted by an exhaust port formed in the cylinder head, an exhaust passage formed in the exhaust passage block in communication with the exhaust port, and a discharge passage formed in the extension section in communication with a hollow portion of the extension case.

According to another aspect of the present invention, there is provided an outboard engine structure in which the water jacket is formed in a region extending from the combustion chamber to an axial intermediate portion of the cylinder bore, and the inlet passage and the outlet passage are formed in the cylinder head.

As described above, according to the present invention, the exhaust gas system is constructed by interposing the exhaust passage block between the lower surface of the cylinder head and the top of the extension section of the extension case. Therefore, even if the position of the cylinder head is substantially displaced from the center line of the hollow portion of the extension case, the exhaust gas of the engine can be exhausted into the hollow portion of the extension case while being effectively cooled without using a conventional long exhaust manifold. In addition, the exhaust gas system of the engine can be disassembled into three sections inclusive of the exhaust port, the exhaust passage and the discharge passage while maintaining the essential portion of the engine and the extension case in coupled state. Accordingly, the exhaust gas system can be readily maintained for its checks and inspections. Since the exhaust port may be formed only in the cylinder head, the shapes of the component members of an engine body can be simplified and can be readily fabricated, contributing to a reduction in the cost.

Further, since the water jacket, the inlet and the outlet passages are constructed as described above, coolant water can be supplied to the water jacket of the cylinder block and the cylinder head without passing the crankcase and the engine can be cooled in response to the temperature gradient of the engine, and even if external cold water is always used as the coolant, the crankcase is not over-cooled, and the lubricating oil can be suitably heated, thereby shortening the warming up time of the engine.

Moreover, in addition to the abovementioned construction of the outboard engine structure, when the inlet and outlet passages of the water jacket are disposed adjacent to the exhaust port, and a water supply passage to connecting the inlet passage with a water feed passage and a drain passage connecting the outlet passage to the hollow portion of the extension case are formed in the exhaust passage block, it is ensured that the oil pan of the engine is not overcooled in the case of feeding water to the water jacket, and the coolant water having passed through the water jacket is passed in the vicinity of the exhaust port and the exhaust passage in the exhaust passage block, thereby effectively cooling the exhaust gas of the engine.

When a bypass is branched from the water feed passage for feeding coolant water to the water jacket, a drain chamber communicating with the bypass is formed in the extension case, a bypass outlet open to the exhaust passage is formed at the side wall of the drain chamber, and a water detecting opening is opened at the bottom wall of the drain chamber, the bypass and the drain chamber can form part of the water detecting passage, thereby simplifying the water passage structure. Further, the exhaust gas discharged from the bypass outlet is allowed to contact the exhaust gas thereby to cool the exhaust gas. Therefore, the temperature drop of the exhaust gas in the extension case is accelerated, and the durability of the driving shaft in contact with the exhaust gas can not only be improved, but the back pressure of the engine is lowered to improve the power of the engine.

The above and other advantages, features and additional object of the present invention will become apparent by those skilled in the art from a reading of the following detailed description of one embodiment found in the accompanying drawings.

DESCRIPTION OF THE PREFERRED EMBODIMENT

An embodiment of the present invention will now be described in greater detail with reference to the accompanying drawings.

Figure 1:
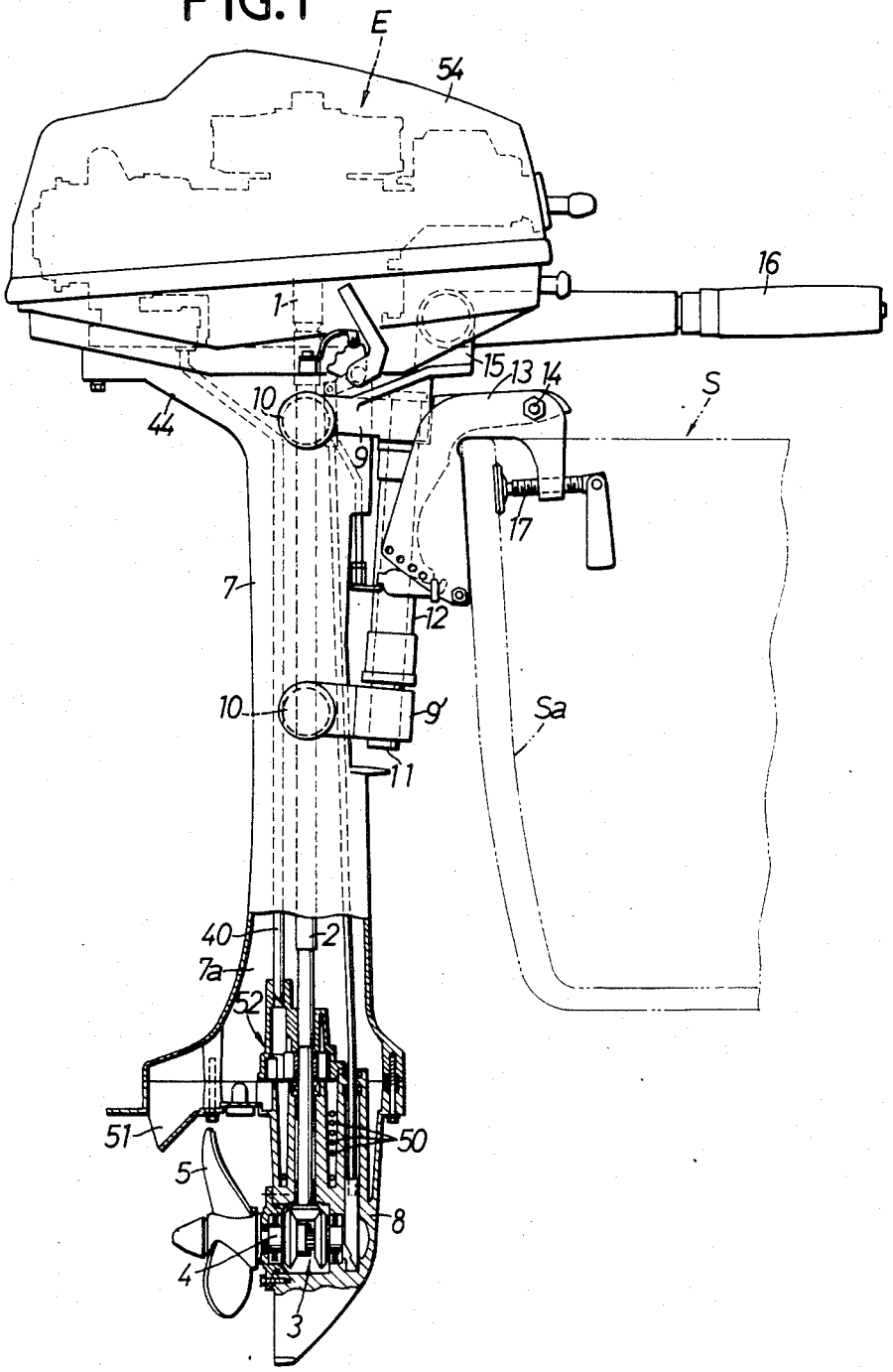
FIG. 1 is a side view of an embodiment of an outboard engine structure according to the present invention partially broken away in section.

In FIG. 1, a four-cycle engine E of an outboard engine structure is disposed with a vertical crankshaft 1, i.e., of vertical type construction. The rotary torque of the crankshaft 1 is transmitted through a vertically disposed driving shaft 2 and a bevel gear transmission 3 to a horizontally disposed propeller shaft 4, for rotatably driving a propeller 5.

An extension case 7 which contains the driving shaft 2 in a hollow portion 7*a* thereof is coupled to the lower surface of the engine E, and a gear case 8 which oil tightly houses the transmission 3 is coupled to the lower surface of the case 7.

A pair of upper and lower extension brackets 9 and 9' are mounted by elastic supporting members 10, 10 on the case 7 so as to project forwardly of the case 7, and the brackets 9 and 9' are coupled through a swivel shaft 11 of substantially vertical dispostion to a swivel case 12 in a steerable manner. The swivel case 12 is upwardly and downwardly tiltably coupled by a horizontal pivot shaft 14 to the tops of a pair of left and right stern brackets 13 and 13 secured detachably by a clamp 17 to the stern plate S*a* of a hull S.

A handle bracket 15 is formed integrally with the upper extension bracket 9, and a steering handle 16 is pivotally secured to the bracket 15.

Figure 2:
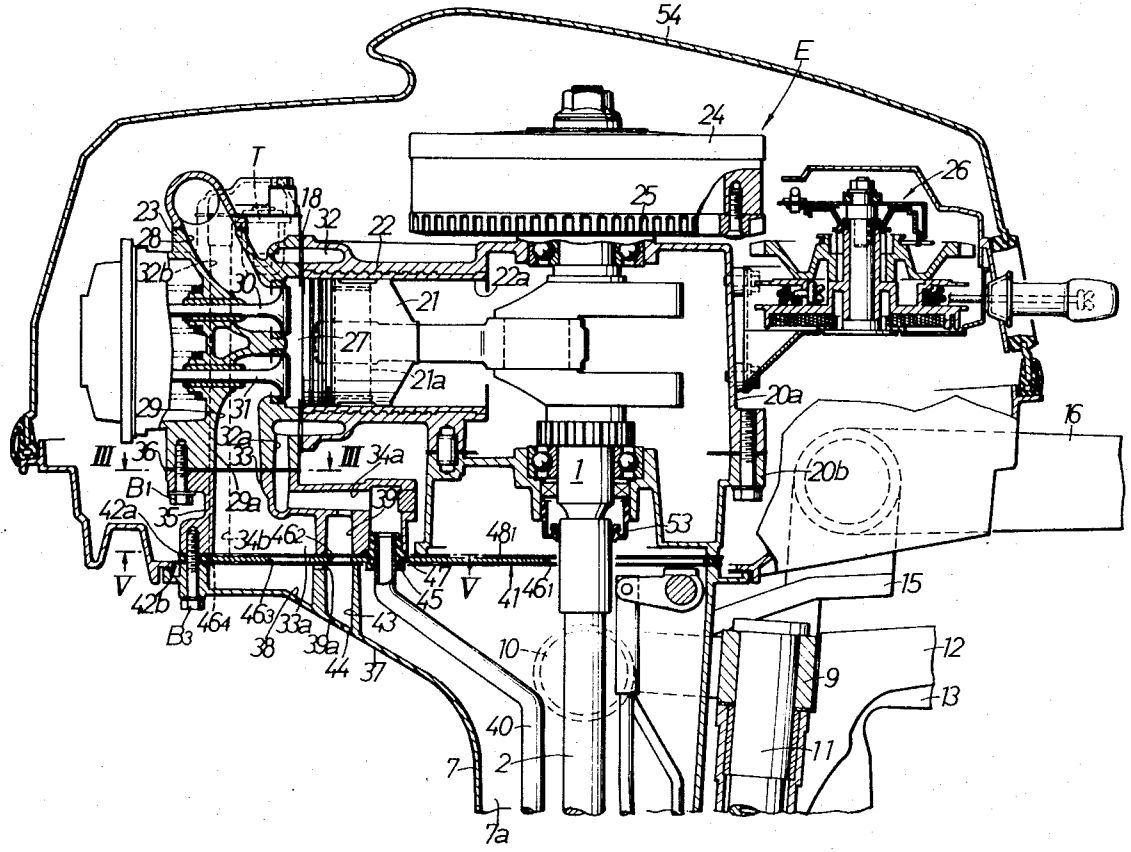
FIG. 2 is an enlarged longitudinal side sectional view of engine, including a portion taken along the line II—II in FIG. 3.
Figure 8:
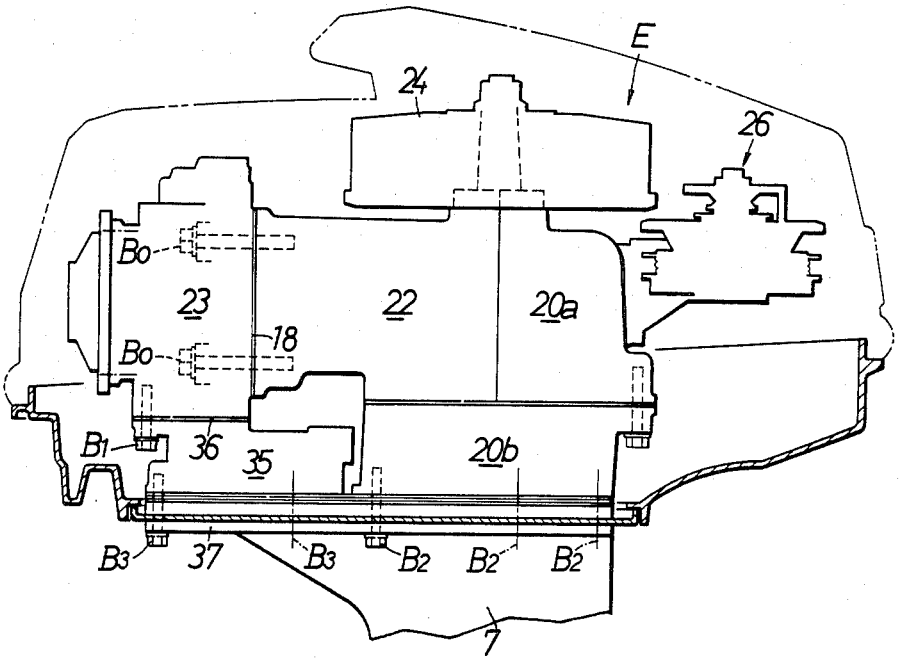
FIGS. 8 and 9 are side and back views of the top of the outboard engine structures showing the coupled state of its component members.
Figure 9:
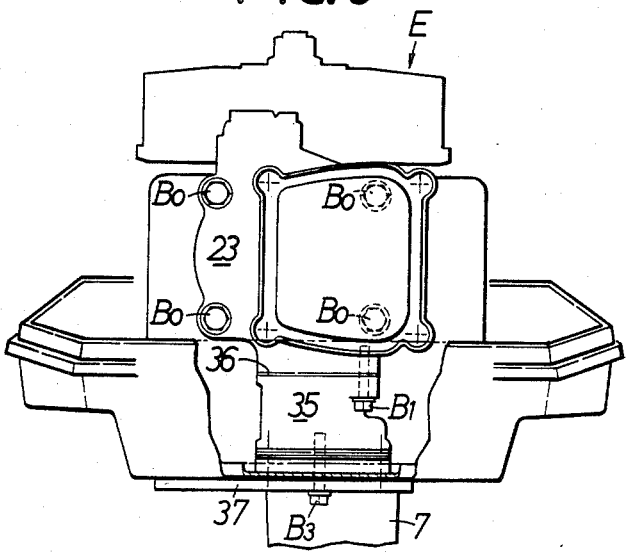

As shown in FIG. 2, the body of the engine E consists of an upper crankcase 20*a* for supporting the upper end of the crankshaft 1, a lower crankcase 20*b* secured to the lower surface of the crankcase 20*a* for supporting the lower end of the crankshaft 1, a cylinder block 22 for slidably receiving a piston 21 connected to the crankshaft 1 in a cylinder bore 22*a*, a cylinder head 23 superposed through a gasket 18 on the end face of the block 22 and coupled together by bolts $B_0$ (see FIGS. 8 and 9), and an exhaust passage block 35 superposed through a gasket 36 to the lower surface of the head 23 and coupled together by bolts $B_1$. The cylinder block 22 is formed integrally with the upper crankcase 20*a* at such position that it is directed rearwardly of the hull S. Therefore, the cylinder head 23 occupies a position at the rear of the engine E. The lower crankcase 20*b* is used also as an oil pan with lubricating oil stored therein.

A starting ring gear 25 is fixedly secured to the lower surface of a flywheel 24 fixedly secured to the upper end of the crankshaft 1, and a recoil type starter 26 for driving the ring gear 25 is mounted on the front wall of the upper crankcase 20*a*.

The cylinder head 23 is formed with a combustion chamber 27 facing the upper end of the piston 21, and an intake port 28 and an exhaust port 29 opening to the chamber 27, and the outlet 29*a* of the port 29 is open at the lower surface of the cylinder head 23. Intake and exhaust ports 28, 29 are opened and closed by intake and exhaust valves 30, 31, respectively.

A serial water cooling jacket 32 is formed in the cylinder block 22 and the cylinder head 23 so as to surround them in a region from the combustion chamber 27 to an axial intermediate portion of the cylinder bore 22*a*. Inlet passage 32*a* and outlet passage 32*b* of the water jacket 32 are formed in the cylinder head 23 and open at the lower surface of the cylinder head 23 side-by-side with the exhaust port 29.

It is noted that the end of the water jacket 32 proximate the cylinder block 22 preferably terminates at the position of the piston pin 21*a* of the piston 21 in the upper dead center position as shown in FIG. 2.

A thermostat T for controlling communication between the water jacket 32 and its outlet passage 32*b* is mounted at the top of the head 23.

An exhaust passage 33 which communicates with the exhaust port 29 is formed in the exhaust passage block 35 in a shoe shape having a bulged section 33*a* extending to the bottom of the lower crankcase 20*b*.

Figure 3:
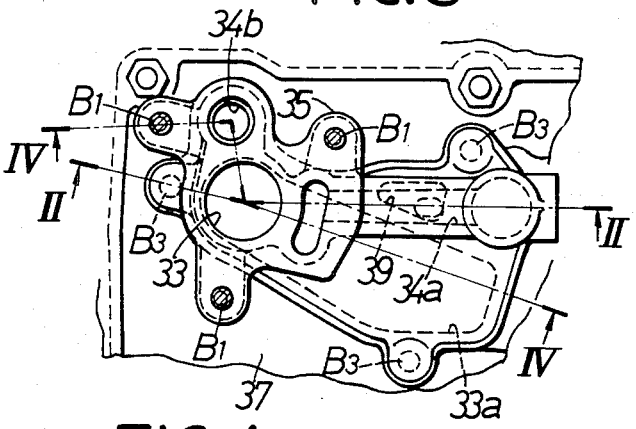
FIG. 3 is a sectional view, taken along line III—III in FIG. 2.
Figure 4:
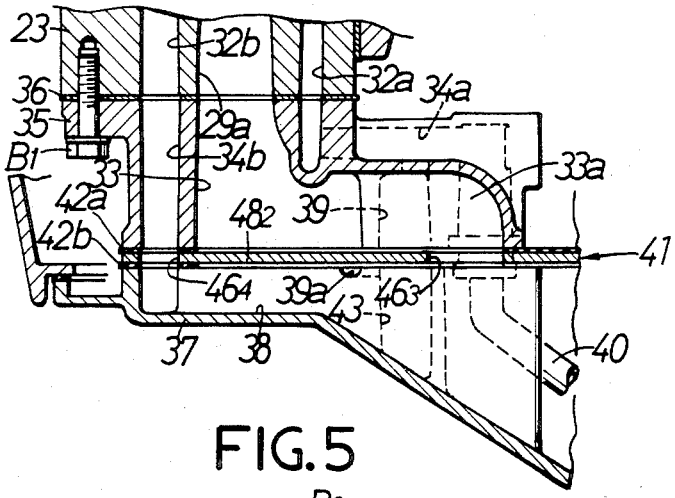
FIG. 4 is a sectional view, taken along line IV—IV in FIG. 3.
Figure 5:
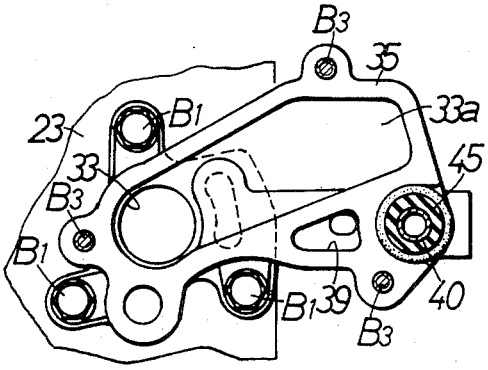
FIG. 5 is a sectional view, taken along line V—V in FIG. 2.

As shown in FIGS. 3 to 5, water supply and drain passages 34*a* and 34*b* which communicate respectively with the inlet and outlet passages 32*a* and 32*b* in the water jacket 32 are formed in the exhaust passage block 35, and are formed together with the exhaust passage 33 at the time of casting the block 35.

Figure 6:
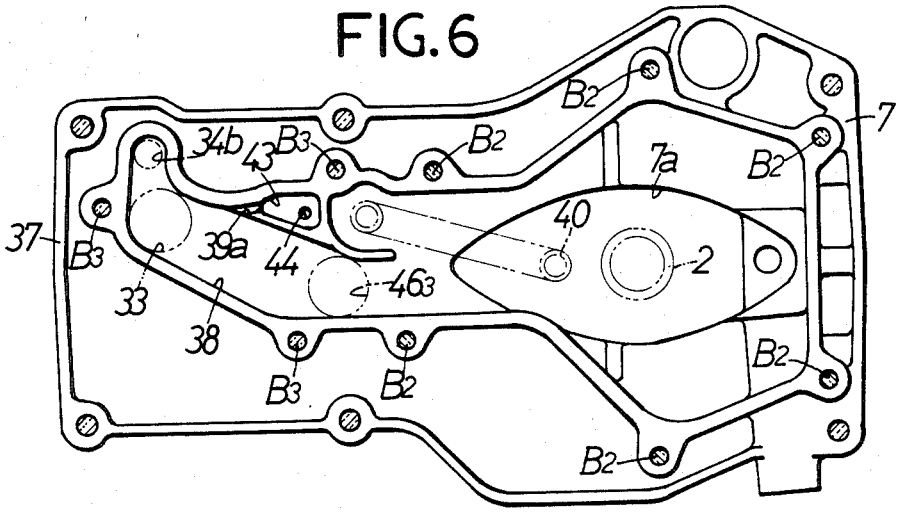
FIG. 6 is a plan view of an extension case of the outboard engine structure.

On the other hand, as shown in FIGS. 2 and 6, an extension section 37 which projects rearwardly is formed integrally with the upper end of the extension case 7. The extension section 37 is formed with a discharge passage 38 for connecting the exhaust passage 33 and the drain passage 34*b* to the hollow portion 7*a* of the extension case 7, and a drain chamber 43 communicating with a bypass 39 in the exhaust passage block 35. The upper surface of the side wall of the drain chamber 43 is formed with a cutout bypass outlet 39*a* opening to the discharge passage 38 leading to the exhaust passage 33, and the bottom wall of the chamber 43 is formed with a water detecting port 44 which opens externally.

In the foregoing description, the exhaust port 29, the exhaust passage 33 and the discharge passage 38 constitute an exhaust system of the engine E.

The lower surface of the exhaust passage block 35 is formed to be flush with the lower surface of the lower crankcase 20*b*, and the upper surface of the extension section 37 is formed flush with the upper surface of the extension case 7. A serial partition plate 41 made of stainless steel plate and a pair of gaskets 42*a* and 42*b* to be superposed on both upper and lower surfaces of the plate 41 are interposed between the opposed surfaces of the block 35, crankcase 20*b*, extension section 37 and the case 7. The lower crankcase 20*b* and the extension case 7 are clamped and fixed together by bolts $B_2$, and the exhaust passage block 35 and the extension section 37 are clamped and fixed together by bolts $B_3$. (Particularly see FIGS. 8 and 9.)

Figure 7:
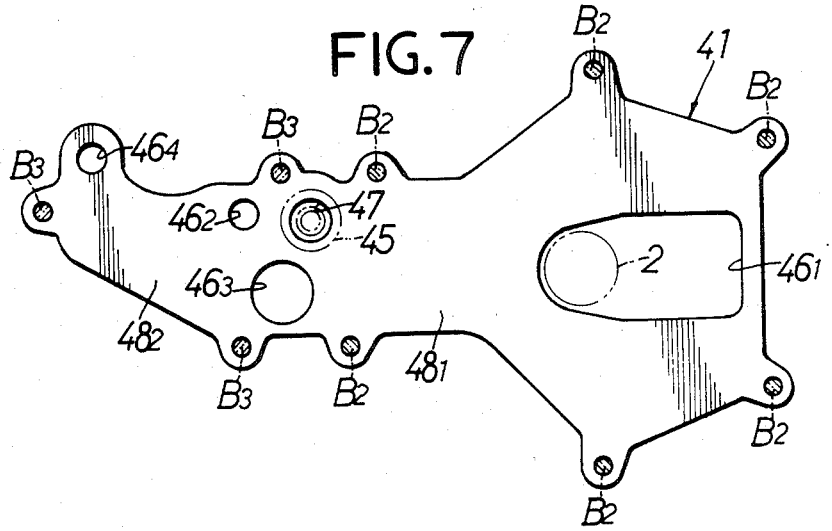
FIG. 7 is a plan view of a partition plate of the outboard engine structure.

As shown in FIGS. 2 and 7, the partition plate 41 is perforated with a first through opening $46_1$ passed by the driving shaft 2, a mounting opening 47 at which a rubber grommet-shaped elastic joint 45 is mounted, a second through opening $46_2$ connecting the bypass 39 and the drain chamber 43, a third through opening $46_3$ connecting the bulged section 33*a* of the exhaust passage 33 and the discharge passage 38, and a fourth through opening $46_4$ connecting the drain passage 34*b* and the discharge passage 38. A portion of the plate 41 between the first and third through openings $46_1$ and $46_3$ of the partition plate 41 is formed as a first partition wall $48_1$ disposed near the driving shaft 2 and extending over the hollow portion 7*a* of the case 7, and another portion of the plate 41 between the third and the fourth through openings $46_3$ and $46_4$ is formed as a second partition wall $48_2$ for isolating those openings from each other by a distance greater than the thickness of the partition wall between the exhaust gas passage 33 and the drain passage 34*b*.

The upper end of the elastic joint 45 mounted on the partition plate 41 is closely fitted in the water supply passage 34*a*, a water feed conduit 40 is disposed longitudinally within the hollow portion 7*a* of the case 7 and has its upper end fitted to the hollow interior of the joint 45, thereby coupling the conduit 40 and the passage 34*a*.

Referring back to FIG. 1, a plurality of small suction ports 50 are formed at the side of the gear case 8, and a discharge port 51 opened at the rear below a draft line. A water pump 52 driven by the shaft 2 is mounted in the gear case 8. The suction ports 50 communicate with the suction side of the pump 52, and the lower end of the conduit 40 is fixedly secured to the discharge side of the pump 52.

In FIG. 2, reference numeral 53 designates a water seal mounted between the lower portion of the lower crankcase 20*b* and the crankshaft 1 passing through the crankcase 20*b*, and reference numeral 54 denotes an engine cover.

The operation of the embodiment of the outboard engine structure will now be described in detail.

Since the water pump 52 driven by the driving shaft 2 sucks external water such as, for example, sea water from the suction ports 50 to feed the water under pressure to the conduit 40 during the operation of the engine E, the thermostat T is closed to shut off flow between the water jacket 32 and the outlet passage 32*b* when the engine is in a cold state. Therefore, the water fed under pressure to the conduit 40 is fed to the passage 34*a*, and then immediately travels from the bypass 39 to the drain chamber 43, and is discharged from the bypass outlet 39*a* and the water detecting opening 44. Consequently, since water does not flow in the water jacket 32, the warm up of the engine E is accelerated.

The water fed out of the bypass outlet 39*a* flows from the discharge passage 38 to the hollow portion 7*a* of the extension case 7, and is discharged from the port 51. The water fed from the opening 44 is observed by an operator of the outboard engine structure, whereby the operating state of the water pump 52 can be confirmed.

Since the bypass outlet 39*a* has its opening end on the passage 38 side directed toward the passage 33, coolant water contacts exhaust gas exhausted from the exhaust passage 33 to the discharge passage 38 to effectively cool the exhaust gas when the coolant water is discharged from the bypass outlet 39*a*.

When the engine E is warmed up and the thermostat T is opened, most of water fed from the conduit 40 to the passage 34*a* is fed from the passage 32*a* to the water jacket 32 while the remaining part of water is fed out to the bypass 39 in the same manner as previously described.

After the water fed to the water jacket 32 cools the top of the cylinder block 22 and the cylinder head 23, the water passes the thermostat T to flow through the passage 32*b* to the passages 34*b*, 38 and the hollow portion 7*a*, and is discharged into external water from the port 51.

Since the coolant water flows into and out of the water jacket 32 through the inlet and outlet passages 32*a* and 32*b* formed in the cylinder head 23 as described above, the flow of the water in the water jacket 32 is rapid around the combustion chamber 27 and slow around the cylinder bore 22*a*, and the water jacket 32 around the cylinder bore 22*a* terminates at an axial intermediate portion of the cylinder bore 22*a*. Accordingly, the engine body is cooled in response to the temperature gradient of the engine E which becomes high temperature toward the combustion chamber 27, thereby avoiding the overcooling of the crankcases 20*a*, 20*b*.

As described above, the coolant water supplied from the conduit 40 is fed to the water jacket 32 without passage through the lower crankcase 20*b*, i.e., the oil pan. Therefore, the lubricating oil in the crankcase 20*b* is not overcooled, but rapidly heated, thereby accelerating the warm up of the engine E, simultaneously effectively cooling the periphery of the exhaust port 29 and hence the exhaust gas by the coolant water.

On the other hand, the exhaust gas exhausted from the combustion chamber 27 of the engine E is discharged sequentially through the port 29, the passage 33 and 38 to the hollow portion 7*a* of the case 7. During this displacement, the exhaust gas is reduced in pressure and heat is transferred to the cylinder head 23, the exhaust passage block 35 and the extension section 37, and further cooled by the coolant in the passage 38, thereby lowering the temperature. Accordingly, even if the exhaust gas contacts the driving shaft 2 in the hollow portion 7*a*, the driving shaft 2 is not overheated. Further, since the first partition wall $48_1$ is disposed above the downstream side opening of the passage 38, the upward flow of the exhaust gas is stopped by the partition wall $48_1$, thereby protecting the water seal 53 from the high temperature of the exhaust gas.

The exhaust gas fed to the hollow portion 7*a* of the case 7 flows downwardly, and is discharged into external water from the port 51 together with the coolant.

When maintenance of the exhaust system of the engine E is performed, the bolts $B_0$, $B_1$, $B_3$ are removed to separate the cylinder block 22 and the cylinder head 23, the cylinder head 23 and the exhaust passage block 35, and the exhaust passage block 35 and the extension section 37. Thus, while the essential portion of the engine E is attached to the case 7, the exhaust system can be disassembled into three sections of the exhaust port 29, the exhaust passage 33 and the discharge passage 38.

What is claimed is:

1. An outboard engine structure comprising a vertical engine including a cylinder head disposed at the rear of the engine, a crankcase, and a vertical crankshaft, an extension case depending from the crankcase and including a hollow portion having a discharge port under a draft line, a driving shaft for driving a propeller shaft, said driving shaft being coupled to said crankshaft and disposed in said hollow portion of said extension case, an exhaust system for the engine which is open to said hollow portion and including an exhaust passage block separately formed from and interposed and coupled between said cylinder head and said extension case, said block having upper and lower surfaces and being secured in position by mounting said upper and lower surfaces respectively against a lower surface of the cylinder head and an upper surface of the extension case at a position remote from the crankcase, said cylinder head having an exhaust port, said exhaust passage block having an exhaust passage in communication with said exhaust port, said extension case having a discharge passage in communication with said exhaust passage and with said hollow portion.

2. An outboard engine structure as claimed in claim 1 wherein said extension case includes an extension section extending rearwardly at an upper part of said case, said exhaust passage block being coupled to said extension section, said discharge passage being in said extension section.

3. An outboard engine structure as claimed in claim 2, further comprising a water jacket having an inlet passage and an outlet passage, a water feed conduit in said hollow portion of said extension case, said inlet and outlet passages being disposed adjacent to said exhaust port, said inlet passage communicating through a water supply passage provided in said exhaust passage block with said water feed conduit, said outlet passage communicating through a drain passage provided in said exhaust passage block with said hollow portion of said extension case.

4. An outboard engine structure as claimed in claim 3, further comprising a bypass branched from said water supply passage, a drain chamber in said extension case in communication with said bypass, a bypass outlet connecting said drain chamber and said exhaust passage, and a water detecting opening provided in a bottom wall of said drain chamber to open externally.

5. An outboard engine structure as claimed in claim 3 wherein the crankcase is mounted at the front of the engine and said inlet and outlet passages are remote from the crankcase.

6. An outboard engine structure as claimed in claim 1, wherein said engine is of a water-cooled four-cycle type.

7. An outboard engine structure comprising a vertical engine including a cylinder block having a bore and comprising a slidable piston in said bore, a cylinder head located at one end of the cylinder block and having a combustion chamber, a crankcase on one side of the block, and a vertical crankshaft;

an extension case depending from the crankcase and including a hollow portion having a discharge port under a draft line, a driving shaft for driving a propeller shaft, said driving shaft being coupled to said crankshaft and disposed in said hollow portion of said extension case, a serial water jacket formed in said cylinder head and said cylinder block to surround a region extending from said combustion chamber to an axially intermediate portion of said cylinder bore, and inlet and outlet passages for said water jacket in said cylinder head, and an exhaust passage block separately formed from the cylinder head and the extension case and interposed and clamped therebetween with an upper surface of the block being partially attached to a lower surface of the cylinder head and a lower surface of the block partially attached to an upper surface of the extension case, said exhaust passage block being located remote from the crankcase.

8. An outboard engine structure as claimed in claim 7 wherein said extension case includes an extension section extending rearwardly at an upper part of said case.

9. An outboard engine structure as claimed in claim 7 comprising a water feed conduit extending in said hollow portion of said extension case, the inlet and outlet passages for said water jacket being disposed adjacent to an exhaust port of said engine, said inlet passage communicating through a water supply passage provided in said exhaust passage block with said water feed conduit, said outlet passage being in communication with said hollow portion of said extension case through a drain passage provided in the exhaust passage block.

10. An outboard engine structure as claimed in claim 9, further comprising a bypass branched from said water supply passage, a drain chamber in said extension case in communication with said bypass, a bypass outlet connecting said drain chamber and said exhaust passage, and a water detecting opening provided in a bottom wall of said drain chamber to open externally.

11. An outboard engine structure as claimed in claim 7, wherein said engine is a water-cooled four-cycle type.

12. An outboard engine structure as claimed in claim 7, wherein said inlet and outlet passages are located in isolation from the crankcase.

* * * * *